US006191750B1

(12) United States Patent
Bonebright

(10) Patent No.: US 6,191,750 B1
(45) Date of Patent: Feb. 20, 2001

(54) TRAVELING WAVE SLOT ANTENNA AND METHOD OF MAKING SAME

(75) Inventor: Mark E. Bonebright, El Cajon, CA (US)

(73) Assignee: Composite Optics, Inc.

( * ) Notice: Under 35 U.S.C. 154(b), the term of this patent shall be extended for 0 days.

(21) Appl. No.: 09/262,163

(22) Filed: Mar. 3, 1999

(51) Int. Cl.[7] ..... H01Q 1/38; H01Q 13/10
(52) U.S. Cl. ..... 343/767; 343/700 MS
(58) Field of Search ..... 343/767, 700 MS, 343/768, 770, 771; H01Q 1/38, 13/10

(56) References Cited

U.S. PATENT DOCUMENTS 5,081,466 * 1/1992 Bitter, Jr. ..... 343/767
5,194,875 * 3/1993 Lucas ..... 343/767
5,404,146 * 4/1995 Rutledge ..... 343/770
5,428,364 * 6/1995 Lee et al. ..... 343/767
5,748,152 * 5/1998 Glabe et al. ..... 343/767
5,949,382 * 9/1999 Quan ..... 343/767

* cited by examiner

*Primary Examiner*—Don Wong
*Assistant Examiner*—Hoang Nguyen
(74) *Attorney, Agent, or Firm*—Higgs, Fletcher & Mack LLP; Bernard L. Kleinke

(57) ABSTRACT

A low profile non-resonant traveling wave slot antenna operating over broad frequency bands is in the form of a multiple layer circuit, which includes a generally planar slotted conductor sheet having an open smoothly curved tapered planar slot therein and a three-dimensionally smoothly curved stripline conductor sheet having an elongated stem portion electrically connected at its distal end to a feed point on top of the slotted conductor sheet and extending downwardly through the slot therein and terminating in an enlarged smoothly tapered portion to transition the characteristic impedance between the feed point and an aperture impedance matched to free space.

15 Claims, 4 Drawing Sheets

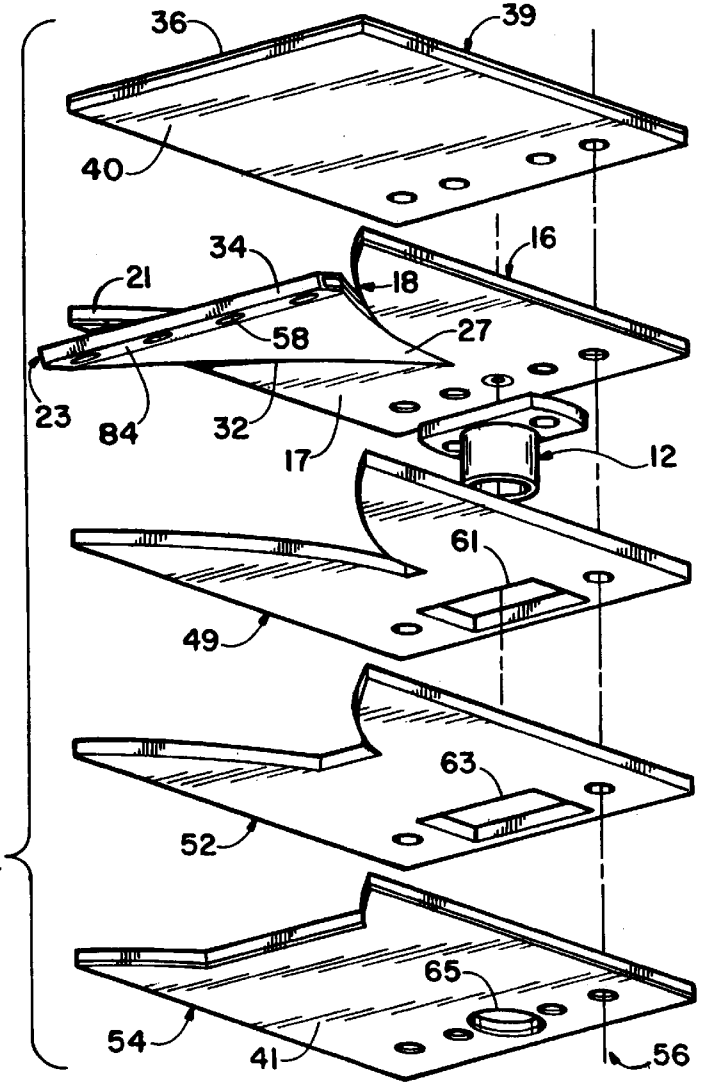
FIG. 11
FIG. 12
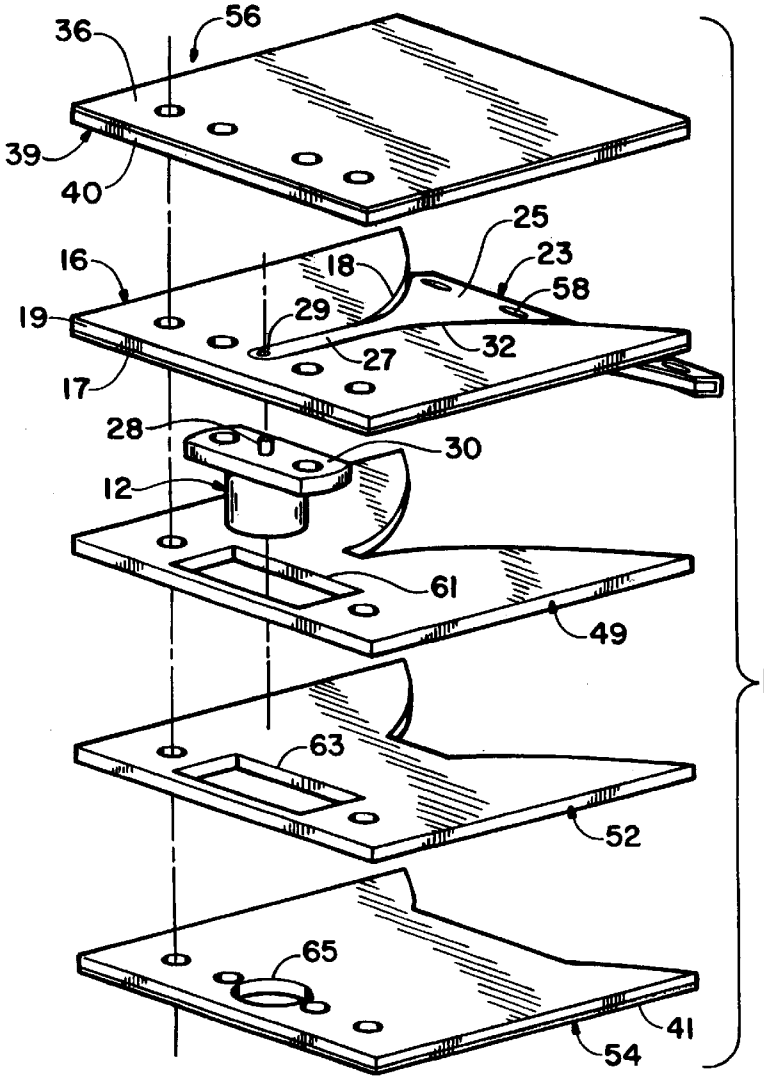

TRAVELING WAVE SLOT ANTENNA AND METHOD OF MAKING SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The present invention relates to a traveling wave slot antenna and a method of making it. The invention more particularly relates to a traveling wave slot antenna, which has a broad frequency band width and which has a low profile configuration to enable it to be mounted, for example, in the outer skin of aircraft as well as many other applications.

2. Background Art

Printed circuit antennae have been known as narrow band elements since the 1960's. Elements making up such an antenna usually take the form of a planar structure with a conductive plate suspended above a ground plane fed at one or more feed points. See, for example, U.S. Pat. No. 5,748,152, which is incorporated herein by reference.

These elements have been used in many applications with wide variations in characteristics. Generally, such an antenna is intended to radiate normal to the ground plane surface to which they are mounted. The antenna elements are commonly fabricated using photolithography techniques on printed circuit board materials. Such techniques allow for very accurate reproduction of the elements in large quantities. These antenna are easily combined into arrays for use at microwave frequencies for communication, Radar and sensing applications.

The U.S. Pat. No. 5,748,152 discloses a slot notch antenna which is generally planar in configuration and has a pair of diverging slot sections terminating in an aperture. The planar antenna is positioned within an open top enclosure above a flat base ground plane. Such a configuration is inherently lossy, and thus not sufficiently efficient for many applications.

While such an antenna may be satisfactory for some applications, it would be highly desirable to have such a low-cost, low profile high bandwidth antenna, which has significantly improved radiation efficiency.

SUMMARY OF THE INVENTION

Therefore, it is the principal object of the present invention to provide a new and improved traveling wave slot antenna and a method of making it, wherein such an antenna has a greatly increased radiation efficiency, and which has a low profile.

Another object of the present invention is to provide such a new and improved antenna and method wherein the method enables the antenna to be manufactured at a relatively low cost.

A further object of the present invention is to provide such an antenna having an element which can be configured as a totally conformal aperture as a single element or in an array.

A still further object of the present invention is to provide a conformal antenna that requires a very small volume to achieve its efficient broadband performance.

A yet another object of the present invention is to provide an antenna which can be fabricated with materials and processes that are low cost while sufficiently accurate to enable high yield production of phased matched array elements.

Another object of the present invention is to provide an antenna which can be realized using high temperature dielectric and adhesives for high temperature environments.

Briefly, the above and further objects of the present invention are realized by providing a traveling wave slot antenna, which is made by printed circuit board techniques and materials in a three-dimensional configuration.

A novel low profile non-resonant traveling wave slot antenna operating over broad frequency bands is in the form of a multiple layer circuit, which includes a generally planar slotted conductor sheet having an open smoothly curved tapered planar slot therein and a three-dimensionally smoothly curved conductor sheet having an elongated stem portion fixedly electrically connected at its distal end to a feed point on top of the slotted conductor sheet and extending downwardly through the slot therein and terminating in an enlarged smoothly tapered portion to transition the characteristic impedance between the feed point and an aperture having an impedance of free space.

The novel antenna is a novel combination of microwave transmission line technology, slot antenna concepts, resistive materials and processes and printed circuit fabrication techniques. The invention relates to the manner this novel design enables the antenna designer to meet desired electrical performance parameters. The inventive antenna design facilitates the following design parameters: Frequency bandwidth, Polarization, Gain, aperture efficiency, other electrical requirements and size, all of which are critical to desired design performance.

The novel antenna is a traveling wave slot which can be accurately constructed using printed circuit materials and processes. In one form of the present invention, it is a coaxial transmission line to stripline transmission line transition that then transitions through a covered microstrip region to a covered coplanar waveguide to feed a broadband terminated di-electrically loaded slot aperture. The coaxial cable to stripline transition has an intrinsically broadband frequency response and is realized using conventional components. The novel transition from stripline transmission line to covered microstrip to covered co-planar waveguide is achieved through a combination of tapering the surface of the three dimensionally curved stripline conductor member and shaping the slotted planar member of the circuit board layers. The electric field created across the slot aperture is very well behaved over a great frequency bandwidth and can be configured to radiate efficiently in a low profile or totally conformal installation.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 11 is an exploded pictorial view of the principal components of the antenna of FIG. 1, illustrating the top, rear and right sides thereof;

FIG. 12 is similar to FIG. 11 and is an exploded pictorial view of the components of the antenna of FIG. 1, illustrating the front, bottom and left sides thereof;

BEST MODE FOR CARRYING OUT THE INVENTION

Figures 1, 2, 3, 4, 5, 6, 7, 8, 9:
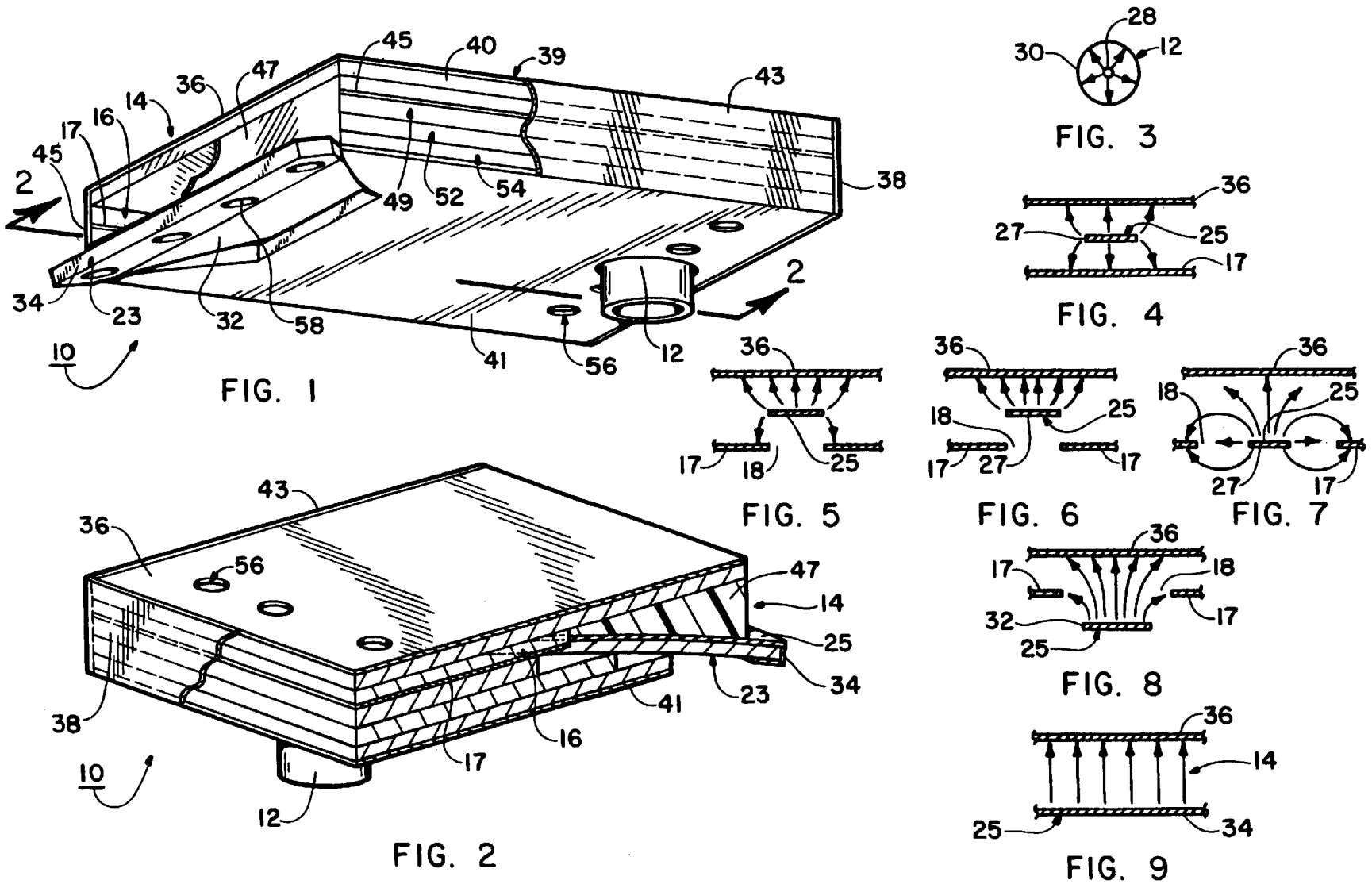
FIG. 1 is a partially broken away pictorial view of a low profile traveling wave slot antenna, which is constructed in accordance with the present invention and illustrates the front, left side and bottom of the antenna.
FIG. 2 is a partially broken away pictorial sectional view taken substantially on line 2—2 of FIG. 2.
FIGS. 3 through 9 are diagrammatic views illustrating an electromagnet traveling wave signal propagating through the antenna of FIG. 1 wherein the characteristic impedance transitions between a feed point and an aperture of the antenna.
Figure 10:
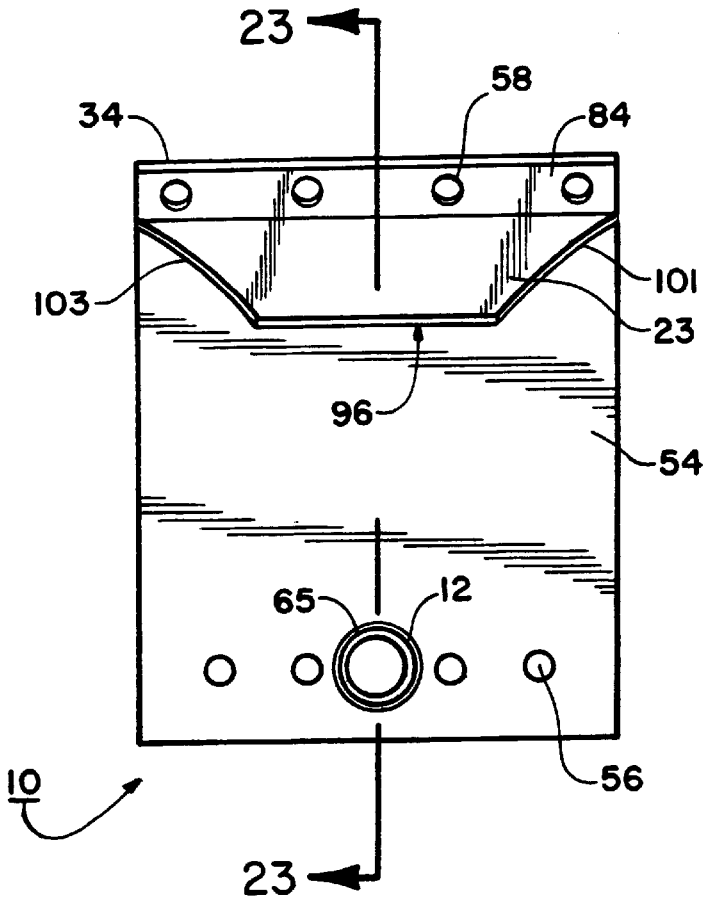
FIG. 10 is a bottom view of the antenna of FIG. 1.
Figure 23:
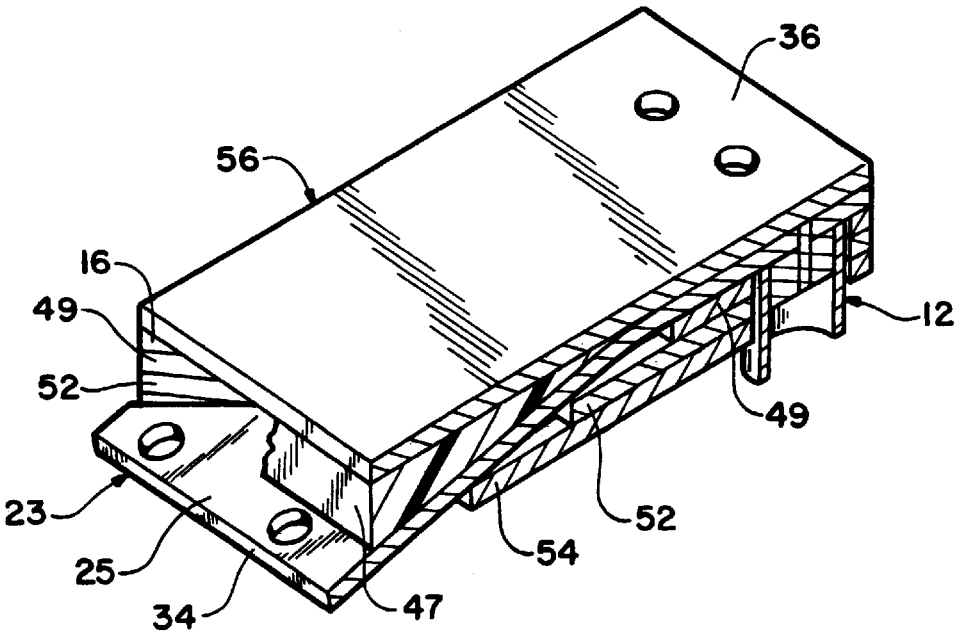
FIG. 23 is a pictorial sectional view of the antenna of FIG. 10 taken substantially on line 23—23 thereof.
Figure 13:
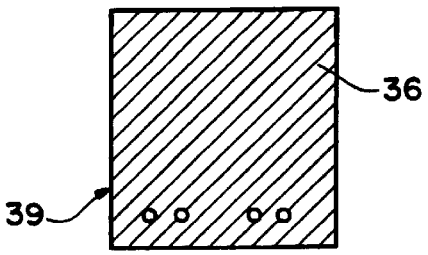
FIGS. 13–17 are reduced scale face views of the top sides of the components of FIGS. 11 and 12.

Referring now to the drawings, and more particular to FIGS. 1 and 2 thereof, there is shown a low profile traveling wave slot antenna 10, which is constructed in accordance with the present invention. The antenna 10 is a non-resonant antenna which operates over broad frequency bands, and can be surface mounted or otherwise used in a conformal application. In this regard, the antenna 10 can be integrated into a vehicle skin or housing (not shown), as well as many other commercial applications including, but not limited to, any application where a small, compact light-weight broad band antenna may be utilized. In accordance with the present invention, the antenna 10 is constructed by utilizing printed circuit technologies in a multiple layer circuit arrangement.

The antenna 10 has a low height compact boxlike rectangular assembly of generally rectangular stacked or layered elements. An upright coaxial feed point connector 12 at the rear end of the antenna 10 conveys electromagnetic signals, which propagate to and from the antenna 10 and transition through progressive sections of smoothly varying impedance characteristics between the connector 12 and a broad band terminated di-electrically loaded slot aperture generally indicated at 14, where the impedance is substantially matched to free space, to enable radiating or receiving electromagnetic wave signals.

Figure 14:
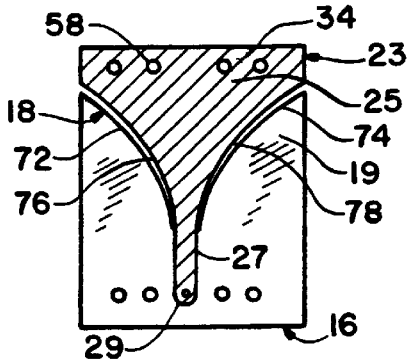
Figure 20:
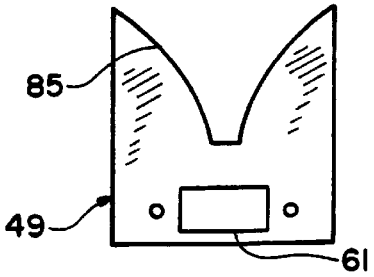

As shown in FIGS. 11, 14, and 20, a generally planar slotted or notched conductor element 16 forms one layer of the antenna 10 and has a generally rectangular planar corresponding slotted or notched conductor sheet 17 (FIGS. 12 and 20) underlying a generally rectangular substrate 19 of the element 16. An open smoothly curved tapered planar generally V-shaped slot 18 is disposed in the conductor element 16, which receives a three dimensionally smoothly curved complementary shaped stripline conductor element 23 (FIGS. 11, 12, 18 and 24) having a correspondingly shaped three dimensionally smoothly curved conductor sheet 25 disposed on the topside thereof to facilitate the smooth transition of the characteristic impedance of the printed circuit transmission line between the coaxial feed connector 12 and free space at the slot aperture 14 as hereinafter described in greater detail.

The stripline conductor element 23 includes an elongated stem portion 27 fixedly and electrically connected at its rear distal end at 29 to a center conductor 28 of the coaxial connector 12 (FIGS. 3 and 11), whereby an outer conductor generally indicated at 30 (FIGS. 3 and 11) is electrically and fixedly connected to the conductor sheet 17 on the underside thereof. As shown in FIGS. 1, 2, 11 and 12, the conductor element 23 includes an enlarged generally triangularly shaped, smoothly tapered portion 32 which extends curvilinearly downwardly from the rear elongated stem portion 27 through the tapered open slot 18 in the planar conductor sheet 17 to help define at its front distal end 34 (FIG. 11) the aperture 14 together with a generally planar imperforate rectangular conductor top plate 36 of a top layer or element 39 having a substrate 40.

As hereinafter described in greater detail with reference to FIGS. 3 through 9, the downwardly curved stripline conductor sheet 25 cooperates with the slotted planar conductor sheet 17 having the tapered slot 18, as well as the top ground plane flat conductor plate 36, to provide a smooth characteristic impedance change between the coaxial connector 12 and the aperture 14. As shown in FIG. 3, the electromagnetic signal in the coaxial connector 12 is generally radial, as indicated, and may have an impedance of near 50 ohms. As shown in FIG. 4, the signal progresses through an impedance change to greater than 50 ohms through a stripline transmission line section configuration including the rectilinear stem portion 27 of the stripline curved conductor 25 being disposed above and parallel to the planar conductor 17 and the ground conductor plate 36.

As shown in FIG. 5, as the curved conductor sheet 25 transitions forwardly along and parallel to an elongated portion of the slot 18, the stem portion 27 extends above the slot 18 in the conductor sheet 17 to further transition continuously and uninterruptedly the stripline to a higher impedance. As the stem 27 extends over a wider portion of the slot 18, the curved conductor sheet 25 cooperates with the planar conductor sheet 17 and the ground plate 36 to enter a covered microstrip section as indicated in FIG. 6, whereby the electromagnetic field extends substantially entirely between the curved conductor sheet 25 and the ground plane plate 36. At such a position, the impedance increases to greater than 0 ohms.

As the curved conductor sheet 25 extends downwardly relative to the top conductor plate 36, as shown in FIG. 7, the stem 27 of the sheet 25 enters the slot 18, and is co-planar with the planar conductor 17. At such a configuration, the traveling waves propogate through a co-planar wave guide section since the stem 27 of the curved sheet 25 is disposed within the slot 18 to help confine the electromagnetic traveling waves between the co-planar sheets 17 and 25 and the spaced apart top conductor plate 36. In the co-planar wave guide section, the impedance increases to near that of free space.

As indicated in FIG. 8, a further transition of the curved sheet 25 at its enlarged portion 32 is disposed below the planar sheet 17 opposite the slot 18. At the aperture 14 as shown in FIG. 9, the traveling wave extends entirely between the distal end 34 of the curved plate 25, and the top conductor plate 36, since the slot 18 of the conductor sheet 17 is no longer present.

At the transitional wave guide section as indicated in FIG. 8, the impedance is still higher. At the aperture 14 indicated at FIG. 9, the impedance matched to about 377 ohms which would be the impedance of free space.

Considering now the antenna 10 in greater detail with reference to FIGS. 1 and 2, a generally planar upright imperforate rectangular conductor back plate 38 interconnects electrically the top ground plate 36 and a generally planar imperforate rectangular conductor base or bottom plate 41. A pair of upright resistive coatings or films 43 and 45 on opposite sides of the antenna 10 help impedance match the element of the low end of its operating frequency band. Similarly, a dielectric filler material 47 (FIGS. 1 and 2) disposed above the sheet 25 help confine the traveling waves within the antenna 10.

A set of three notched spacer plates 49, 52 and 54 are mounted below the member 16 to help position the curved sheet 25 as indicated in the drawings. A set of four vertically aligned mounting holes, such as the set of vertically aligned mounting holes 56 extending through the rear end portion of the antenna 10 secure the various layers in position, it being understood that the fastening devices are not shown for sake of illustration purposes. A set of mounting holes, such as the hole 58 in the distal end 34 of the stripline curved conductor element 23 enables the distal end 34 to be secured in place and provides for an electrical contact to the vehicle surface to which it is mounted. The spacer plates 49, 52 and 54 have at their respective rear end portions mounting holes 61, 63 and 65 for the connector 12, which includes an apertured flange 67 received within the rectangular holes 61 and 63.

Figure 19:
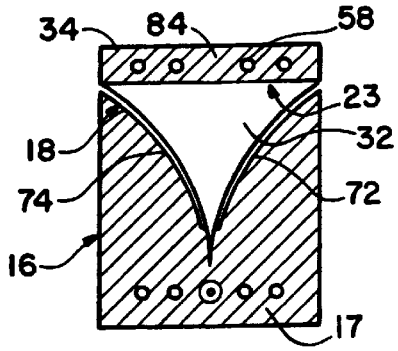
Figure 15:
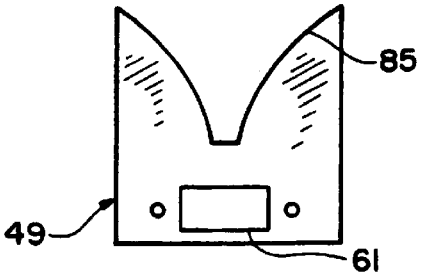

Considering now the planar conductor element 16 in greater detail with reference to FIGS. 14 and 19, the slot 18 is generally V-shaped and is preferably formed by a pair of smoothly rounded inwardly curved slit openings 72 and 74. Preferably, the strip line conductor element 23 is integrally connected at its stemportion 27 to the remaining portion of the element 16. In this regard, the conductor sheet 25 is formed as a conductor layer on the substrate 19.

Figure 18:
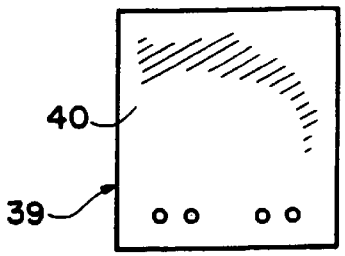
FIGS. 18–22 are reduced scale face views of the bottom sides of the components of FIGS. 11 and 12, the stripline conductor element shown in FIGS. 14 and 19 being an illustration of it in its flat configuration prior to assembly into the antenna of FIGS. 1–12.

As shown in FIGS. 18 and 24, the stripline curved conductor element 23 includes a pair of smoothly rounded outwardly flared intermediate edge portions 76 and 78 interconnecting the elongated stem portion 27 and the enlarged portion 32. A pair of gently outwardly curved side edges 81 and 83 of the enlarged tapered portion 32 is smoothly continues with the respective intermediate edge portions 76 and 78. A bottom conductor strip 84 (FIGS. 12 and 24) is connected integrally over the distal end 34 with the conductor sheet 25.

Considering now the notched spacer plate 49 in greater detail, the plate 49 is a layer disposed immediately below the element 16. The plate 49 includes a generally V-shaped slot or notch 85, which is generally similar in size and shape as the slot 21 and which is axially aligned therewith.

Figure 16:
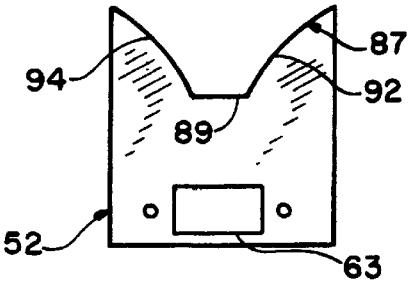
Figure 21:
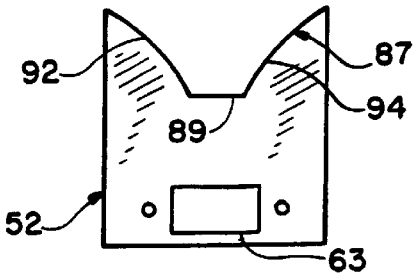

The spacer plate 52 as shown in FIGS. 16 and 21 is disposed immediately below the plate 49 and includes a moderately shallow slot or notch 87, which is similar in size and shape as a portion of the slot 85. The slot 87 includes a bight portion 89 interconnecting a pair of smoothly rounded inwardly curved leg portions 92 and 94 similar to corresponding portions of the respective leg portions of the slot 85 of the spacer plate 49. The slot 87 is axially aligned with the deeper slot 85. Due to the shallowness of the slot 87, the bight 89 is substantially longer than the light of the slot 85.

Figure 17:
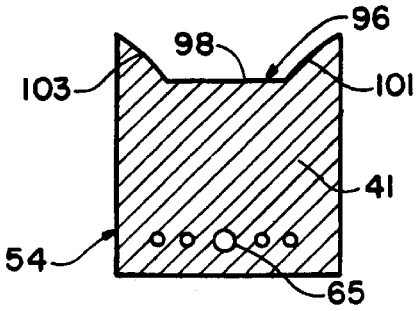
Figure 22:
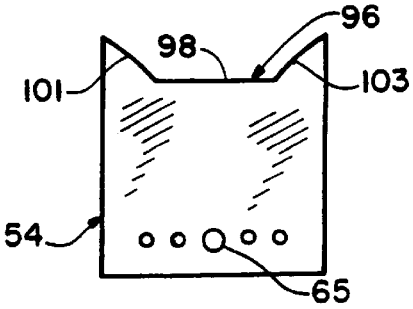

Similarly, the spacer plate 54 (FIGS. 17 and 22) is disposed below the plate 52, and includes a shallow slot or notch 96, which is similar in size and shape as the slot 87 and is axially aligned therewith. The slot 96 includes a bight portion 98, which is substantially longer than the bight portion 89 of the slot 87.

Thus, the progressively more shallow spacer slots are axially aligned to receive the downwardly extending stripline conductor element 23 to position precisely the downwardly curvilinear disposition and support it intermediate its ends 29 and 34 which are fixed in place.

The antenna 10 is preferable made by printed circuit photolithography techniques on printed circuit board materials.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A low profile traveling wave slot antenna comprising:

feed point connector means for conveying broad band width electrical signals;

a generally planar slotted conductor sheet having an open smoothly curved tapered planar slot therein and being connected electrically to said feed point means;

a three-dimensionally smoothly curved stripline conductor sheet having an elongated stem portion electrically connected at its distal end to said feed point means on top of said slotted conductor sheet and extending downwardly through said slot and terminating in an enlarged smoothly tapered portion to provide at its free distal end a signal radiating or receiving aperture; and a generally planar imperforate top conductor plate extending generally parallel to said slotted conductor sheet to cooperate with said slotted sheet and said stripline curved conductor sheet to provide a series of continuous traveling wave sections having continuously and progressively increasing characteristic impedance from said connector means to said aperture.

2. A low profile traveling wave slot antenna according to claim 1, wherein one of said sections includes a stripline transmission line section electrically connected to said connector means.

3. A low profile traveling wave slot antenna according to claim 2, wherein one of said sections includes a covered micro strip transmission line section extending from said stripline section and being electrically connected thereto for guiding electrical signals between said connector means and said micro strip section via said stripline section.

4. A low profile traveling wave slot antenna according to claim 3, wherein one of said sections includes a co-planar wave guide section extending from said micro strip section and being electrically connected thereto for guiding electrical signals between said connector means and said wave guide section.

5. A low profile traveling wave slot antenna according to claim 4, wherein one of said sections includes an aperture section extending from said micro strip section extending from said co-planar wave guide section and being electrically connected thereto for launching or receiving electrical signals.

6. A low profile traveling wave slot antenna according to claim 1, further including dielectric material above said stripline conductor sheet.

7. A low profile traveling wave slot antenna according to claim 1, further including a base conductor plate interconnected electrically with said top conductor plate.

8. A low profile traveling wave slot antenna according to claim 1, further including a pair of resistive coatings.

9. A low profile traveling wave slot antenna according to claim 1, wherein said tapered slot is generally V-shaped having a bight portion interconnecting a pair of inwardly cured leg portions.

10. A low profile traveling wave slot antenna according to claim 9, wherein said stripline conductor sheet includes a generally triangularly shaped smoothly tapered, enlarged portion extending curvilinearly downwardly from the rear elongated stem portion through said tapered open slot to provide at its front distal end to help define said aperture together with said top conductor plate.

11. A method of making a low profile traveling wave slot antenna, comprising:

using a generally planar slotted conductor sheet having an open smoothly curved tapered planar slot therein;

connecting electrically to a feed point connector means to the conductor sheet;

using a three-dimensionally smoothly curved stripline conductor sheet having an elongated stem portion;

connecting electrically at its distal end to said feed point connector means on top of said slotted conductor sheet;

extending said stripline conductor sheet downwardly through said slot and terminating in an enlarged smoothly tapered portion to provide at its free distal end a signal radiating or receiving aperture; and positioning a generally planar imperforate top conductor plate extending generally parallel to said slotted conductor sheet to cooperate with said slotted sheet and said curved stripline conductor sheet to provide a series of continuous traveling wave sections having continuously and progressively increasing characteristic impedance from said connector means to said aperture.

12. A method of making a low profile traveling wave slot antenna according to claim 11, further including connecting one of said sections as a stripline transmission line section to said connector means.

13. A method according to claim 12, further including connecting one of the sections as a covered micro strip transmission line section to said stripline section.

14. A method according to claim 13, further including connecting one of said sections as a co-planar wave guide section to said microstrip section for guiding electrical signals between said connector means and said wave guide section.

15. A method according to claim 14, further including connecting one of said sections as an aperture section extending to said co-planar wave guide section and being electrically connected thereto for launching or receiving electrical signals.

* * * * *